United States Patent [19]

Kruesi et al.

[11] 4,323,390

[45] Apr. 6, 1982

[54] PROCESS FOR CONVERTING BRASS SCRAP TO COPPER POWDER

[75] Inventors: Paul R. Kruesi, Golden; Veryl H. Frahm, Jr., Boulder, both of Colo.

[73] Assignee: Southern Foundry Supply Company, Chattanooga, Tenn.

[21] Appl. No.: 105,614

[22] Filed: Dec. 20, 1979

[51] Int. Cl.[3] ..... B22F 9/00

[52] U.S. Cl. ..... 75/0.5 A; 75/0.5 B; 75/72; 75/101 R; 75/114; 75/117

[58] Field of Search ..... 75/0.5 R, 0.5 A, 0.5 AA, 75/0.5 AB, 0.5 AC, 0.5 B, 0.5 BA, 0.5 BB, 0.5 BC, 72, 101 R, 110, 111, 114, 115, 117, 120; 148/6.31; 241/17; 423/38, 109, 39, 40, 103

[56] References Cited

U.S. PATENT DOCUMENTS

| | | | |
|---|---|---|---|
| 1,353,773 | 9/1920 | Marsh | 423/40 |
| 2,645,573 | 7/1953 | Drapeau, Jr. | 75/0.5 A |
| 3,269,831 | 8/1966 | Wilson | 75/101 R |
| 3,313,616 | 4/1967 | Tuvell | 75/0.5 |
| 3,616,277 | 10/1971 | Adamson et al. | 204/10 |
| 3,689,248 | 9/1972 | Mehl | 75/72 |
| 3,765,866 | 10/1973 | Nayar | 75/0.5 B |
| 3,905,808 | 9/1975 | Bzura | 75/101 R |
| 4,018,595 | 4/1977 | Genik-Sas-Berezowsky | 75/0.5 A |

OTHER PUBLICATIONS

Dunbar, R. E., *General Chemistry* revised edition, Littlefield, Adams & Co., Paterson, N.J., p. 170 (1964).

Abrams, R. B., "The Dezincification of Brass" *Trans. of the Am. Electrochemical Soc.*, pp. 39–50 (1923).

Colegate, G. T., "Dezincification" *Metal Industry*, (12/24/48) pp. 507–509.

Merriman, A. D.; *A Dictionary of Metallurgy* MacDonald & Evans, Ltd., pp. 22–23 (1958).

Schwarzkopf, P.; *Powder Metallurgy Its Physics and Production*, Macmillan Co., pp. 31–32 (1947).

Weast, R. C., ed.; *Handbook of Chemistry and Physics* 51st edition; CRC, Cleveland, OH, pp. D–176, 189, 213 (1970).

*Primary Examiner*—Michael L. Lewis

*Attorney, Agent, or Firm*—Sheridan, Ross & McIntosh

[57] ABSTRACT

Copper powder is produced from brass by reacting the brass with hydrochloric acid in an oxygen-free atmosphere at a temperature of at least 70° C. until the non-copper metals and impurities of the brass are dissolved, oxidizing at least 10 percent by weight of the resulting copper to copper oxides, grinding the copper-copper oxide to a powder and removing the copper oxides of the powder to obtain a pure copper powder.

24 Claims, No Drawings

PROCESS FOR CONVERTING BRASS SCRAP TO COPPER POWDER

DESCRIPTION

1. Technical Field

The process of the invention relates to the production of high purity copper powders from brass, particularly brass scraps.

2. Background Art

A large demand for copper powders has developed, due to the wide variety of utilities for copper powder, for example, as a pigment in paints, as a heat dispersant in brake linings, in powder metallurgy in preparation of iron parts and in the preparation of bearings. A number of techniques have been used to prepare copper powders. Examples of such techniques include the hydrogen reduction of copper sulfate to copper in autoclaves at high temperature, production of copper powders electrolytically by plating at high current densities and the production of atomized copper powder by dispersing molten copper with a stream of water.

PRIOR ART STATEMENT

Patents representative of the prior art include U.S. Pat. No. 3,616,277 which discloses the production of copper powder by electrolysis from copper-containing solutions. U.S. Pat. No. 3,313,616 teaches a process for decarbonizing a copper powder by heating it to 400°-1200° F. in the presence of air. The copper powder which is purified can be obtained, for example, from the leaching of a copper source with ammoniacal ammonium carbonate, thereafter subjecting the pregnant solution containing the copper to a reduction process and then decarbonizing the copper. U.S. Pat. No. 4,018,595 discloses a process for producing oxide free copper by reacting an acidic sulfate aqueous solution containing copper salts with a reducing gas at an elevated temperature and pressure in the presence of an agent selected from the group consisting of polymeric polyamine compounds having amino groups linked by alkyl groups having 2 to 4 carbon atoms in order to precipitate metallic copper.

However, all of the processes of the prior art require that the copper be totally dissolved and then reproduced in a powder form. The techniques of the prior art are therefore uneconomical for production of copper powder from brass. The process of the present invention permits the production of high quality copper powders from low cost brass without the necessity of dissolving the copper.

DISCLOSURE OF THE INVENTION

Brass is reacted with hydrochloric acid at a temperature of at least 70° C. in an oxygen-free environment for a sufficient time to dissolve the non-copper metals and impurities contained in the brass. In the absence of oxygen, the hydrochloric acid will not significantly dissolve the copper. The resulting copper is washed, dried and then heated to a temperature of from about 450° C. to about 500° C. in an oxidizing atmosphere in order to cause at least 10 percent by weight of the copper to be oxidized to copper oxides. The copper-copper oxide is then ground to a powder of desired size and thereafter the copper oxide coating is removed to obtain copper powder. The removal may be performed by contacting the copper oxides with a reducing gas at elevated temperatures of from about 400° C. to about 500° C. or by contacting the copper oxides with a mineral acid.

BEST MODE FOR CARRYING OUT THE INVENTION

For the purposes of this invention, the term brass means a copper zinc alloy which may contain other metals but which does not contain silicon, greater than about 5 percent tin or greater than about 5 percent nickel. Examples of such brasses include gilding metal, commercial bronze, red brass, yellow brass, muntz metal, aluminum bronze, leaded yellow brass, brazing solder and manganese bronze. Examples of unsuitable brasses include, for example, tin bronzes, phosphor bronzes, nickel silver containing greater than about 5 percent tin or nickel and silicon bronze. The presence of tin or nickel inhibits the dissolution of the zinc and is, therefore, undesirable.

Any grade of brass can be treated, including scrap. It is preferred that the brass have a substantial surface area. Examples of brass which have a relatively high surface to weight ratio include machine turnings and grindings and radiator tubes. The brass cannot be so thick as to preclude the ability of the hydrochloric acid to dissolve the non-copper metals and impurities contained within the brass. Thus, if necessary, the brass is reduced in size to obtain pieces which are less than about 6.5 millimeters in thickness.

The brass is then reacted with hot hydrochloric acid. The treatment of the brass with hydrochloric acid should be conducted in an oxygen-free atmosphere to prevent the dissolution of the copper. Although the copper would be replated, the presence of the oxygen results in a less efficient removal of zinc. The temperature of the acid leach of the brass should be conducted at a temperature of at least 70° C. At temperatures lower than this, the dissolution proceeds at a very slow rate. The temperature range of the acid leach will generally be from about 70° C. to about 110° C. and it is preferred that the temperature be the boiling point of the aqueous hydrochloric acid solution. Temperatures above 110° C. may be used; however, because such temperatures exceed the boiling point of hydrochloric acid the dissolution will need to be conducted in a pressure vessel. At temperatures higher than 110° C. there is no real practical acceleration of the dissolution of the brass. It is preferred that the acid leach be conducted under reflux conditions in order to maximize the rate of the dissolution.

When the hydrochloric acid is maintained at its boiling point then the concentration of the hydrochloric acid is not critical because the acid will form a constant boiling azeotrope with water which has a boiling point of approximately 110° C. at atmospheric pressure and which contains approximately 20.2 percent by weight hydrochloric acid. The boiling of weaker or stronger aqueous solutions of hydrochloric acid results in either the loss of water or hydrochloric acid until the constant boiling hydrochloric acid is obtained. When the temperature of the hydrochloric acid treatment is less than the boiling point of the hydrochloric acid then it is preferred that the concentration of the hydrochloric acid be from about 10 to about 38 percent by weight hydrochloric acid. Hydrochloric acid having a concentration of less than 10 percent by weight will work; however, its reaction with the brass is very slow. Although acid more concentrated than 38 percent may be used, it is more difficult to maintain its acid concentration and it does not substantially improve the dissolution. It is most preferred that hydrochloric acid be used at its azeotropic concentration at a temperature of about 110° C. under reflux conditions.

The hydrochloric acid is used in an amount which is at least 100 percent in excess of the stoichiometric amount required to dissolve the zinc contained in the brass. At concentrations of hydrochloric acid which are less than 100 percent of the stoichiometric amount needed to dissolve the zinc, the hydrochloric acid will not be as effective in dissolving the zinc. Any amount of hydrochloric acid in excess of a 100 percent of the stoichiometric amount needed to dissolve the zinc can be used. It is preferred that the hydrochloric acid be used in an amount about 100 percent to about 150 percent in excess of the stoichiometric amount required to dissolve the zinc present in the brass.

The time required to complete the dissolution of the non-copper metals and impurities contained in the brass is dependent upon the thickness of the brass being treated, the concentration of hydrochloric acid, the temperature of the acid treatment and the degree of copper purity desired. Generally, the time will vary from about 4 hours to about 12 hours. For example, brass turnings have a thickness of about 0.13 millimeters (0.005 inch) and a brass sheet having a thickness of about 0.51 millimeters (0.02 inch) were treated for about 5 hours in order to obtain a level of zinc of about 0.5 percent. To obtain a level of less than about 0.1 percent zinc would require about 12 hours. Longer or shorter periods of time can be used depending upon the purity of the copper desired.

The copper resulting from the hydrochloric acid treatment is porous and is greatly weakened in comparison with the original brass. However, the copper may still be coherent and have the shape of the original copper alloy piece or pieces. Direct grinding of this copper to obtain a powder is difficult because the pure copper is malleable and tends to weld together into a mass. The copper is made amenable to grinding by oxidizing a portion of the surface of the copper. Prior to the oxidation treatment, it is preferred that the copper be washed and dried.

The surface oxidation is conducted at a temperature of from about 450° C. to about 500° C. in an oxygen-containing atmosphere for times ranging from about 10 minutes to about 45 minutes. Temperatures less than about 450° C. may be used; however, the rate of oxidation will be much slower. Temperatures greater than about 500° C. may also be used; however, the oxidation occurs so quickly that it is difficult to control and it is difficult to prevent the sintering of some, if not all, of the copper. Thus, the preferred temperature range of the oxidation treatment is from about 450° C. to about 500° C. The time required for the oxidation treatment is dependent upon the thickness of the copper pieces being treated and the temperature of the oxidation. It is preferred that the oxidation be conducted under conditions which cause the oxidation of from about 10 to about 30 percent by weight of the copper. If less than about 10 percent of the copper is oxidized, then the copper will still have a tendency to weld together into a mass when ground. Conversion of greater than about 30 percent of the copper present is of no benefit to the grinding process. The oxidation of the copper particles to copper oxide makes the copper-copper oxide particles brittle and readily susceptible to grinding in a wide variety of grinding devices.

After the copper-copper oxide particles have been ground to a desired size, the copper oxide coating is removed to obtain copper. The removal may be accomplished by reduction performed by contacting the copper-copper oxide particles with a reducing gas or by contacting the copper oxide with a mineral acid, such as hydrochloric acid. When a reducing gas is used, it is preferred that the copper oxide coated particles be reduced by contacting them with hydrogen or a reducing gas mixture of hydrogen and carbon monoxide at a temperature from about 400° C. to about 500° C. Temperatures lower than 400° C. can be used; however, the rate of reduction is much slower. Again, temperatures greater than 500° C. can be used; however, it is more difficult to control the reduction and it is more difficult to prevent the sintering of the copper. It is also preferred that the gas reduction reaction occur in a turbulent environment in order to help prevent sintering of the copper particles.

Alternatively, the copper oxide may be removed by contacting the copper oxide coated particles with a mineral acid in order to dissolve the copper oxide. The copper powder is then washed and dried under non-oxidizing conditions to produce a pure copper powder free of oxide. Examples of mineral acids include hydrochloric acid and sulfuric acid. Hydrochloric acid is the preferred mineral acid. The mineral acid is employed in at least the stoichiometric amount required to dissolve the copper oxide present. The resulting copper is then washed to remove the mineral acid and dried under non-oxidizing conditions. Water is an example of a suitable wash.

EXAMPLES

Example 1

A piece of radiator brass was cut from an automobile radiator. It weighed 1.66 grams. It was digested with 200 millimeters of 37 percent by weight hydrochloric acid at 95° C. for 18 hours under reflux conditions. The resulting metal was assayed and it contained 97.6 percent copper and 0.6 percent zinc. The product was rinsed in water, dried and heated in the presence of air to 500° C. for 20 minutes in a furnace. The resulting piece was ground to a powder in a mortar and pestle and reduced to copper metal by exposure to hydrogen gas at 400° C. for 1 hour.

Example 2

A sample of 20 grams of leaded yellow brass turnings was deoiled with tetrachloroethylene. The brass turnings were assayed and found to contain 54.6 percent copper, 42 percent zinc, 2.9 percent lead and 0.1 percent tin. The turnings were digested with 100 milliliters of 20 percent by weight hydrochloric acid under reflux conditions at a temperature of 110° C. for 7 hours. The metal turnings after dissolution were assayed and were found to contain 97 percent copper, 0.5 percent zinc, 0.0005 percent lead and 0.03 percent tin. The metal turnings were then roasted in the presence of air at a temperature of 500° C. for 45 minutes. About 35 percent of the copper was converted to copper oxide. The material was then ground and reduced with hydrogen gas at a temperature of 400° C. to a copper powder.

Example 3

Three different 20 gram samples of yellow brass turnings containing 54.6 percent copper, 42 percent zinc and 2.9 percent lead were each digested with 100 milliliters of azeotropic (about 20.2 percent by weight acid) hydrochloric acid for 6 hours. The digesting of the first sample was conducted under reflux conditions at a temperature of about 110° C. and 99.4 percent of the zinc was removed. The digestion of the second sample was conducted under reflux conditions at a temperature of 90° C. and 78 percent of the zinc was removed. The digestion of the third sample was conducted under reflux conditions at 70° C. and 66 percent of the zinc was removed.

Example 4

Two different 20 gram samples of yellow brass turnings having the same composition as those of Example 3 were digested in 100 milliliters of azeotropic hydrochloric acid and in 10 percent by weight hydrochloric acid, respectively. Each sample was digested for 6 hours under reflux conditions at a temperature of 110° C. The digestion with the azeotropic hydrochloric acid resulted in 99.4 percent of the zinc being removed. The digestion of the brass turnings in the 10.3 percent acid resulted in 65 percent of the zinc being removed.

Example 5

A sample of bronze turnings having a composition of 90 percent copper, 5 percent tin and 4 percent zinc was digested in azeotropic hydrochloric acid for 6 hours under reflux conditions at 110° C. The resulting metal was assayed and found to contain 4 percent zinc and 5.3 percent tin. Apparently, the presence of tin prevented the selective digestion of the zinc.

What is claimed is:

1. A process for the production of copper powder from brass, wherein the brass does not contain silicon, greater than about 5 percent tin, or greater than about 5 percent nickel, comprising:

(a) reacting the brass with hydrochloric acid in an oxygen-free atmosphere at a temperature of at least 70° C. until the non-copper metals and impurities contained in the brass are dissolved;

(b) oxidizing at least 10 percent by weight of the copper from step (a) to copper oxides;

(c) grinding the copper of step (b) to a powder; and (d) removing the copper oxides contained in the powder of step (c) to obtain copper powder.

2. The process of claim 1 wherein the concentration of the hydrochloric acid is from about 10 to about 38 percent by weight.

3. The process of claim 1 wherein the temperature of the reaction of the brass with the hydrochloric acid is conducted at a temperature of from about 70° C. to about 110° C.

4. The process of claim 1 wherein the oxidizing step (b) is conducted at a temperature from about 450° C. to about 500° C.

5. The process of claim 1 wherein the copper oxides are removed by reducing the copper oxides to copper.

6. The process of claim 1 wherein the reduction of copper oxides is done at a temperature of from about 400° C. to about 500° C. in the presence of a reducing gas.

7. The process of claim 6 wherein the reducing gas is selected from the group consisting of hydrogen and a mixture of hydrogen and carbon monoxide.

8. The process of claim 1 wherein the copper oxides are removed by dissolving the copper oxides with a mineral acid.

9. The process of claim 8 wherein the mineral acid is selected from the group consisting of hydrochloric acid and sulfuric acid.

10. A process for the production of copper powder from brass, wherein the brass does not contain silicon, greater than about 5 percent tin or greater than about 5 percent nickel, comprising:

(a) reacting the brass with from about 10 to about 38 percent by weight hydrochloric acid in an oxygen-free atmosphere at a temperature of from about 70° C. to about 110° C. until the non-copper metals and impurities contained in the brass are dissolved;

(b) oxidizing at least 10 percent by weight of the copper from step (a) to copper oxides at a temperature of from about 450° C. to about 500° C. in an oxygen containing atmosphere;

(c) grinding the copper of step (b) to a powder; and (d) removing the copper oxides contained in the powder of step (c) to obtain copper powder.

11. The process of claim 1 or claim 10 wherein the temperature of the hydrochloric acid is maintained at boiling.

12. The process of claim 1 or claim 10 wherein the hydrochloric acid is an azeotrope with water.

13. The process of claim 10 wherein the copper oxides are removed by their reduction and the reduction is conducted at a temperature of from about 400° C. to about 500° C. in the presence of a reducing gas.

14. The process of claim 13 wherein the temperature of the hydrochloric acid is maintained at about 110° C. and the reaction of the brass with hydrochloric acid is conducted under reflux conditions.

15. The process of claim 13 wherein the reducing gas of step (d) is selected from the group consisting of hydrogen and a mixture of hydrogen and carbon monoxide.

16. The process of claim 15 wherein the reducing gas of step (d) is hydrogen.

17. The process of claim 10 wherein the removal of the copper oxides is conducted by contacting the powder of step (c) with a mineral acid, washing the copper powder and drying it under non-oxidizing conditions to produce a pure copper powder.

18. The process of claim 17 wherein the mineral acid is hydrochloric acid.

19. The process of claim 17 wherein the mineral acid is sulfuric acid.

20. The process of claim 1 or claim 10 wherein the reaction of the brass with the hydrochloric acid is conducted for a period of time sufficient to reduce the concentration of zinc contained in the brass to less than about 0.5 percent.

21. The process of claim 1 or claim 10 wherein the reaction of the brass with the hydrochloric acid is conducted for a period of time sufficient to reduce the concentration of zinc contained in the brass to less than about 0.1 percent.

22. The process of claim 1 or claim 10 wherein the thickness of the brass prior to treatment with the hydrochloric acid is less than about 6.5 millimeters in thickness.

23. The process of claim 22 wherein the reaction of the brass with the hydrochloric acid is conducted for a time period of from about 4 to about 12 hours and the oxidation reaction of step (b) is conducted for a time period of from about 10 to about 45 minutes.

24. A process for the production of copper powder from brass, wherein the brass does not contain silicon, greater than about five percent tin or greater than about five percent nickel, comprising:

(a) reacting the brass with hydrochloric acid in an oxygen-free atmosphere until the non-copper metals and impurities contained in the brass are dissolved;

(b) oxidizing at least ten percent by weight of the copper from step (a) to copper oxide;

(c) grinding the copper of step (b) to a powder; and (d) removing the copper oxides contained in the powder of step (c) to obtain copper powder.

* * * * *